US005107255A

United States Patent [19]

Shiraishi

[11] Patent Number: 5,107,255

[45] Date of Patent: Apr. 21, 1992

[54] CONTROL DEVICE FOR A DISPLAY APPARATUS

[75] Inventor: Tai Shiraishi, Nara, Japan

[73] Assignee: Sharp Kabushiki Kaisha, Osaka, Japan

[21] Appl. No.: 435,023

[22] Filed: Nov. 13, 1989

[30] Foreign Application Priority Data

Nov. 15, 1988 [JP] Japan ..... 63-289111

[51] Int. Cl.[5] ..... G09G 1/06

[52] U.S. Cl. ..... 340/731; 340/723; 358/451; 382/47

[58] Field of Search ..... 340/723, 724, 731, 721, 340/750; 358/13, 451, 467, 457; 382/47

[56] References Cited

U.S. PATENT DOCUMENTS

| | | | |
|---|---|---|---|
| 4,484,302 | 11/1984 | Carson et al. | 364/900 |
| 4,707,729 | 11/1987 | Bruno et al. | 358/13 |
| 4,803,478 | 2/1989 | Olsen | 340/724 |
| 4,809,099 | 12/1989 | Takano | 340/724 |
| 4,907,171 | 3/1990 | Nagashima | 340/731 |

FOREIGN PATENT DOCUMENTS

| | | |
|---|---|---|
| 57-97580 | 6/1982 | Japan . |
| 62-31352 | 7/1987 | Japan . |
| 1-225997 | 3/1988 | Japan . |
| 1-277890 | 11/1989 | Japan . |

*Primary Examiner*—Alvin E. Oberley
*Assistant Examiner*—Xiao M. Wu
*Attorney, Agent, or Firm*—Nixon & Vanderhye

[57] ABSTRACT

A control device for a display apparatus such as an LCD is disclosed. The control device can operate in the window display mode or in the reduced display mode. The control device copmrises: an image data string generating unit for generating a first serial image data string in synchronization with the horizontal scanning: an image data delaying unit for generating a second serial image data string in which each data is delayed from the corresponding data of said first image data string by a period of time corresponding to at least one pixel: a mask signal generator for generating a plurality of mask signals: a first operation unit for applying an OR or AND operation to the first and second iamge data strings to obtain a third image data string: a second operation means for applying an AND or OR operation to the first and second image data strings to obtain a fourth image data string: a mask signal selector for selecting mask signals from the mask signals in accordance with a desired display mode: a data image selector for selecting image data strings from the first to fourth image data strings, and producing a further image data string: and an output unit for masking the further image data string in accordance with the selected mask signals, and outputting the masked iamge data string to the display apparatus.

6 Claims, 7 Drawing Sheets

UPPER AREA
LOWER AREA
UX0
UX1
UX7
LX0
LX1
LX7
Y0
Y3
Y4
Y7
DU0-3
DL
HS
VS
DL0-3
BUFFER
LCD CONTROL
I/F
TIMING
LCD CONTROLLER
CONTROL
CPU
VRAM
MPX
MPX
L1
L2
L3
L4
L5
L6
L7
L8
L9
1
2
4
5
6
7
8
9
10
11
12
13
14
15

CONTROL DEVICE FOR A DISPLAY APPARATUS

BACKGROUND OF THE INVENTION

1. Field of the Invention

This invention relates to a display control device for a display apparatus, which may be advantageously employed as a display means in a computer system such as a personal computer, a word processor or the like.

2. Description of the Prior Art.

A cathode-ray tube or a liquid crystal display panel is used as a display means for a personal computer, a word processor or the like. The screen of such a display means is composed of a plurality of picture elements (pixels) arranged in a matrix to form visual display areas. On the other hand, image data to be displayed on such a display means are stored in an image memory (video random access memory which is hereinafter referred to as "VRAM"), and are controlled by an application software. The area in the VRAM managed by an application software is known as the world coordinate area, and the display area formed on the screen of the display means as the screen coordinate area.

When the world coordinate area has the same size as the screen coordinate area, no problem arises. But, when the screen coordinate area is smaller than the world coordinate area, for example, when the screen coordinate area is made up of pixels of 640 dots per horizontal line (width) and 480 dots per vertical line (height) while the world coordinate are consists of 720-dot horizontal lines and 480- dot vertical lines, the problem arises in that the display area on the screen cannot cover the full width of the world coordinate area in the horizontal direction.

To overcome the above-mentioned problem, there has previously been employed either of the following two techniques.

One is a window display technique in which pixel data representing 640 dots shown in (1) of FIG. 6 are extracted from a world coordinate area A1 to be displayed on a screen P1, P2 or P3 which corresponds to a screen coordinate area A2. For example, as shown in (2) of FIG. 6, pixel data representing 640 dots beginning from point a to point e in the horizontal direction is extracted from the world coordinate areas A1 to be displayed as the screen P1. In this case, the image portion formed on 40 dots at each side of the world coordinate area A1 is not displayed. In the case shown in (3) of FIG. 6, pixel data representing 640 dots beginning from point b (which is the starting point of the horizontal line) to point d are extracted from the world coordinate area A1 to be displayed as the screen P2. In this case, the image portion formed on 80 dots at the right side of the world coordinate area A1 is not displayed. In the case shown in (4) of FIG. 6, pixel data representing 640 dots beginning from point c to the right edge of the world coordinate area A1 are extracted to be displayed as the screen P3, so that the image portion formed on 80 dots at the left side of the world coordinate area is not displayed. By sequentially displaying the screens P1, P2 and P3, each having a missing image portion, in a suitable manner, the whole image can be displayed on the screen. In the prior art, the addresss change for reading out the world coordinate area A1 in the VRAM mentioned above is executed by instructions from the software.

The other prior art technique is a so-called reduced display technique in which, as shown in FIG. 7, the ratio of 640:720 (=8:9), which is the ratio of the number of dots on the screen coordinates area A2 to that on the world coordinate areas A1 in the horizontal direction, is taken as the reduction ratio for the pixel data in the horizontal direction to be displayed on the screen. More specifically, data representing nine pixels are extracted from the VRAM to be converted to data representing eight pixels, and the converted data are rewritten into the VRAM. Then the converted data are read out from the VRAM to be displayed, so that the image reduced to 8:9 in the horizontal direction is displaced on the screen.

The above-mentioned window display technique has the drawbacks that the world corrdinate area A1 cannot be displayed at one time, and that the address for reading data from a VRAM has to be forcibly changed to the one different from that specified by the original software, resulting in the loss of software compatibility with regard to display control.

On the other hand, with the reduced display technique, because pixel data must be reduced with a predetermined reduction ratio (e.g., 8:9) in the horizontal direction, a prolonged period of time is required for data processing, resulting in that it is difficult to conduct the realtime display. Moreover, since the process involves the modification of the contents of the VRAM, the original data will be lost. The once lost data cannot be restored. Furthermore, if data are reduced simply to 8:9, one data is lost for every nine data, which leads to the distortion of the resulting image although the entire area can be displayed. Also, with the software available in the prior art, it is not possible to accomplish the reduction ratio of 8:9, and in practice, a reciprocal number of a power of 2 such as $\frac{1}{2}$, $\frac{1}{4}$, etc. has been used to determine the reduction ratio. This results in the loss of the compatibility of softwares because of the intervention of a software required for such reduction processing.

SUMMARY OF THE INVENTION

The control device for a display apparatus of this invention, which overcomes the above-discussed and numerous other disadvantages and deficiencies of the prior art, comprises: an image data string generating means for generating a first serial image data string in synchronization with the horizontal scanning of said display apparatus, said image being connected to a memory means for storing image data: an image data delaying means for generating a second serial image data string in which each data is delayed from the corresponding data of said first image data string by a period of time corresponding to at least one pixel: a mask signal generating means for generating a plurality of mask signals: a first operation means for applying a first operation to said first and second image data strings to obtain a third image data string: a mask signal selecting means for selecting one or more mask signals from said mask signals in accordance with a desired display mode: a data image selecting means for selecting one or more image data strings from said first to third image data strings, and producing a further image data string: and an output means for masking said further image data string in accordance with said selected mask signals, and outputting said masked image data string to said display apparatus.

In a preferred embodiment, the first operation is an OR operation.

In a preferred embodiment, the first operation is an OR operation.

In a preferred embodiment, the first operation is an AND operation.

The control device for a display apparatus comprises: an image data string generating means for generating a first serial image data string in synchronization with the horizontal scanning of said display apparatus, said image being connected to a memory means for storing image data: an image data delaying means for generating a second serial image data string in which each data is delayed from the corresponding data of said first image data string by a period of time corresponding to at least one pixel: a mask signal generating means for generating a plurality of mask signals: a first operation means for applying a first operation to said first and second image data strings to obtain a third image data string: a second operation means for applying a second operation to said first and second image data strings to obtain a fourth image data string: a mask signal selecting means for selecting one or more mask signals from said mask signals in accordance with a desired display mode: a data image selecting means for selecting one or more image data strings from said first to fourth image data strings, and producing a further image data string: and an output means for masking said further image data string in accordance with said selected mask signals, and outputting said masked image data string to said display apparatus.

In a preferred embodiment, the first operation is an OR operation.

In a preferred embodiment, the second operation is an AND operation.

Thus, the invention descrbed herein makes possible the objectives of:

(1) providing a control device for a display apparatus which can arbitrarily operate in either of the window display mode or the reduced display mode:
(2) providing a control device for a display apparatus which can deliver an image to the display apparatus without substantially losing stored image data:
(3) providing a control device for a display apparatus which can operate in either of the window display mode or the reduced display mode without losing software compatibility:
(4) providing a control device for a display apparatus which can process image data without affecting the contents of a video memory:
(5) providing a control device for a display apparatus which can process image data in real time: and
(6) providing a control device for a display apparatus which can process image data in a hardware base.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
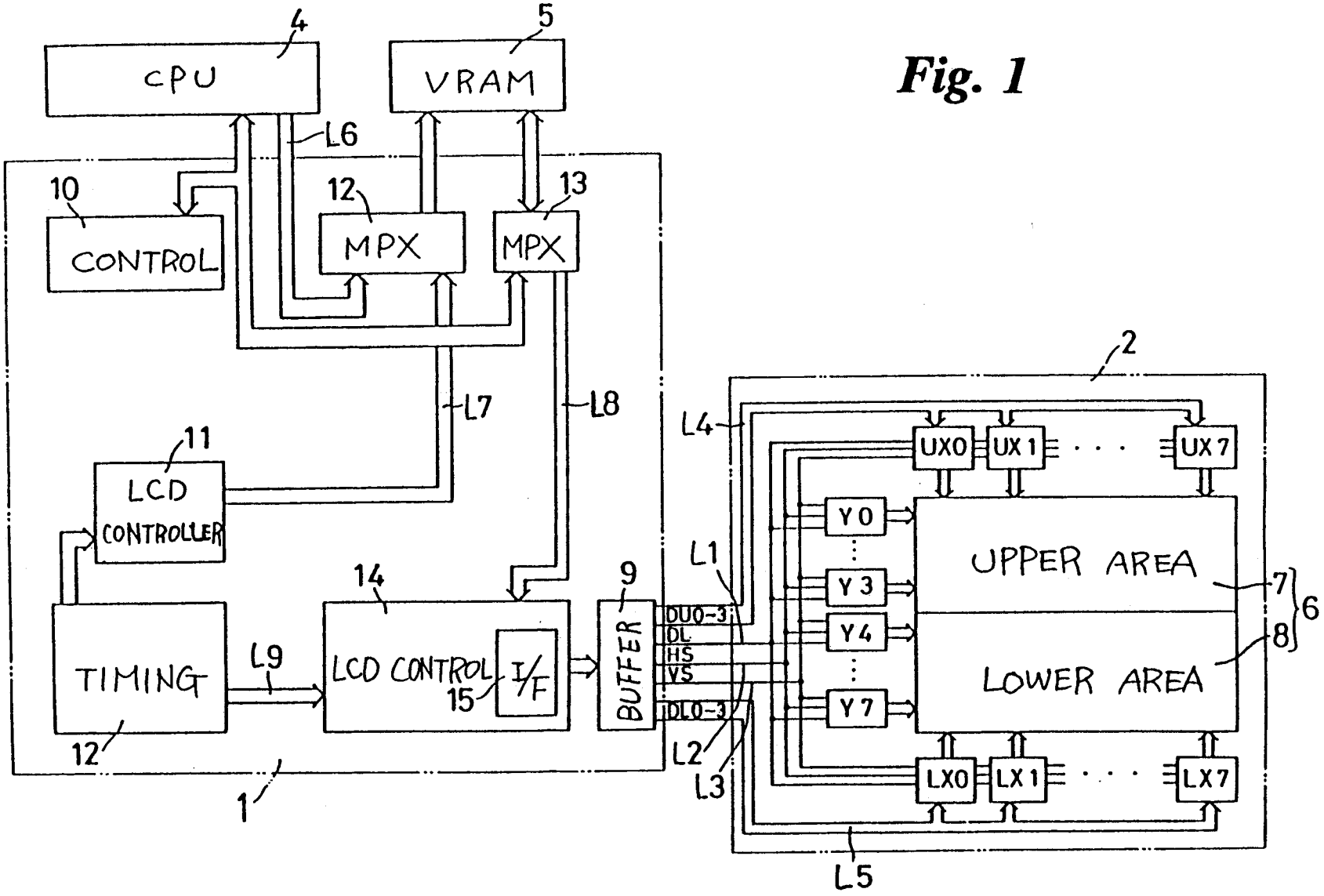
FIG. 1 is a block diagram illustrating the control device according to the invention.

FIG. 1 is a block diagram showing a control device according to the invention. The control device 1 shown in FIG. 1 is for a liquid crystal display (LCD) apparatus 2 used in a personal computer system or a word processor system. The LCD apparatus 2 is coupled to the control device 1 via a plurality of control lines L1 to L5 which will be described later. The control device is connected are a central processing unit 4 which includes a microprocessor (not shown), and an image memory (hereinafter referred to as "VRAM") 5.

The LCD apparatus 2 includes a display panel 6 having pixels of 640×480 dots which are arranged in a matrix form. The display panel 6 is split into an upper display are 7 and a lower display are 8. The uper display area 7 is driven by eight segment-electrode driving circuits UX0 to UX7 and four common-electrode driving circuits Y0 to Y3. The lower display area 8 is driven by eight segment-electrode driving circuits LX0 to LX7 and four common-electrode driving circuits Y4 to Y7. That is, the common electrodes driving circuits Y0 to Y3 and Y4 to Y7 drive respectively the display of 60 lines, and the segment-electrode driving circuits UX0 to UX7 and LX0 to LX7 drive respectively the display of 80 dots in each selected lines. A data latch signal DL, a line control signal HS, and an area control signal VS are supplied via control lines L1, L2 and L3, respectively from a buffer circuit 9 in the control device 1, to the segment-electrode driving circuits UX0 to UX7 and LX0 to LX7 and the common-electrode driving circuits Y0 to Y7. Display data DU0 to DU3 for the upper display area are supplied to the segment-electrode driving circuits UX0 to UX7 through a data bus line L4, and display data DL0 to DL3 for the lower display area are supplied to the segment-electrode driving circuits LX0 to LX7 through data bus line L5.

The control device 1 comprises a control memory section 10, an LCD controller 11, a timing signal genrating circuit 12, a first multiplexer 13A, a second multiplexer 13B, and an LCD control section 14. The control memory section 10 stores various control information supplied from the central processing unit 4, such as a display start address for the VRAM 5, offset values designating the capacity of one line, line selection information, scroll information, etc. The LCD controller 11 functions in the same manner as a conventional CRT controller to deliver display data for 720 dots in the horizontal line from the VRAM 5. The timing signal generating circuit 12 supplies synchronizing signals for the various control operations. Address buses L6 and L7 from the central processing unit 4 and the LCD controller 11, respectively, are connected to the first multiplexer 13A to selectively supply address data to the VRAM 5. The switching between the read mode and the write mode of the VRAM 5 is controlled by the second multiplexer 13B. The LCD control section 14 supplies image data read from the VRAM 5 to the LCD apparatus 2 via an interface unit 15 and the buffer circuit 9. The operation of the LCD control section 14 will be described below.

In the following, the case will be described in which an image in a world coordinate area comprising 720 dots in the horizontal direction is displayed on the LCD apparatus 2 having a screen coordinate area comprising 640 dots in the horizontal direction. That is, the reduction ratio is 640:720 (=8:9). An AND operation or OR operation is applied to two adjacent pixel values out of nine pixels, and the operation result is defined as the image data of one pixel so that the image data of the nine pixels are displayed with eight pixels.

The pixel values in the world coordinate area comprising 720 dots are denoted by $P_{i,j}$, and the pixel values in the screen coordinate area on the LCD apparatus 2 comprising 640 dots by $q_{i,j}$. An operation is performed so that the following relationship is established between the two.

$$q_{8k,j}=p_{9k,j}*p_{9k+1,j}$$

$$q_{8k+1,j}=p_{9k+1+1,j}$$

where the symbol "*" is an operand representing the AND operation or OR operation. The subscripts j, k, l are integers and represents:

$$0 \leqq K \leqq 79$$

$$1 \leqq 1 \leqq 7$$

$$0 \leqq j \leqq (\text{number of pixels in vertical direction})-1$$

In the embodiment, the value representing the first pixel $q_{0,0}$ on the first line is obtained by applying an AND or OR operation to the values representing $p_{0,0}$ and $p_{1,0}$, while values representing $p_{2,0}$ to $p_{8,0}$ are taken as values representing the second to eighth pixels $q_{1,0}$ to $q_{7,0}$, respectively. A value representing the ninth pixel $q_{8,0}$ is obtained by applying an AND or OR operation to values representing $p_{9,0}$ and $p_{10,0}$. The same sequence of processing is repeated until the value representing $q_{639,0}$ is obtained. After completion of the first horizontal period, the processing proceeds to the second horizontal line where the value representing the first pixel $q_{0,1}$ is obtained by applying an AND or OR operation to values representing $p_{0,1}$ and $p_{1,1}$, and the similar sequence of processing as mentioned above is repeated to complete the second horizontal scanning period.

Figure 2:
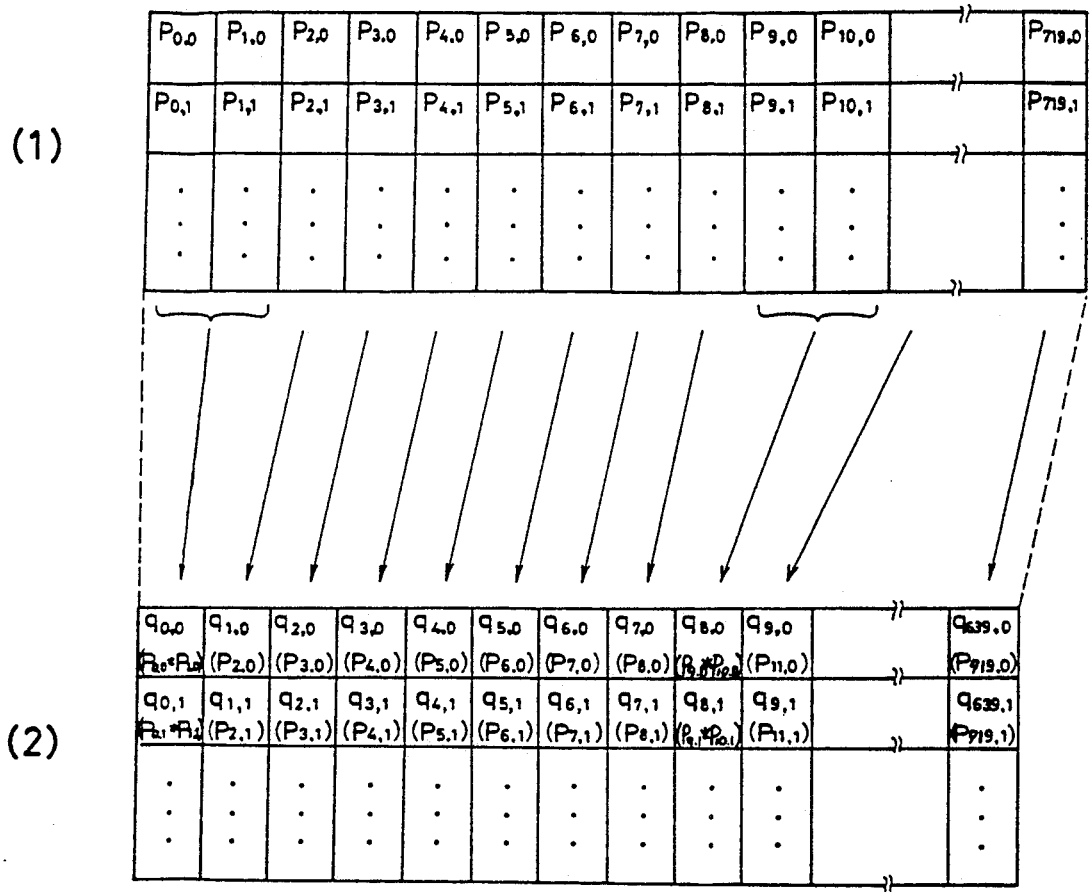
FIG. 2 diagrammatically illustrates the reduction of pixel data in the control device of FIG. 1.

FIG. 2 illustrates the pixel data reduction in which the world coordinate area comprising 720-dot horizontal lines is reduced to the 640-dot screen coordinate area. The pixel data $p_{0,0}$ to $p_{719,0}$ and $p_{0,1}$ to $p_{719,1}$ for the first and second lines in the world coordinate area are shown in (1) of FIG. 2, while pixel data $q_{0,0}$ to $q_{639,0}$ and $q_{0,1}$ to $q_{639,1}$ for the first and second lines in the 640-dot screen coordinate area which are obtained by the aforementioned operations are shown in (2) of FIG. 2. The data for the subsequent lines are obtained in the same manner.

In (2) of FIG. 2, the values in parentheses are the corresponding values in the world coordinate shown in (1) of FIG. 2. For example, the value representing the first pixel $q_{0,0}$ on the first line in the screen coordinate area is obtained as a result of and AND or OR operation applied to the first pixel data $p_{0,0}$ and the second pixel data $p_{1,0}$ adjacent to the first value on the first line in the world coordinate area, and the first pixel data $q_{0,1}$ on the second line in the screen coordinate area is obtained as a result of an AND or OR operation applied to the first pixel data $p_{0,1}$ and the second pixel data $p_{1,1}$ on the second line in the world coordinate area. In the embodiment, the above operation is performed on the first, 9th, 17th, . . . pixel data on each line in the world coordinate area, thereby making it possible to display the data of nine pixels with eight pixels.

Figure 3:
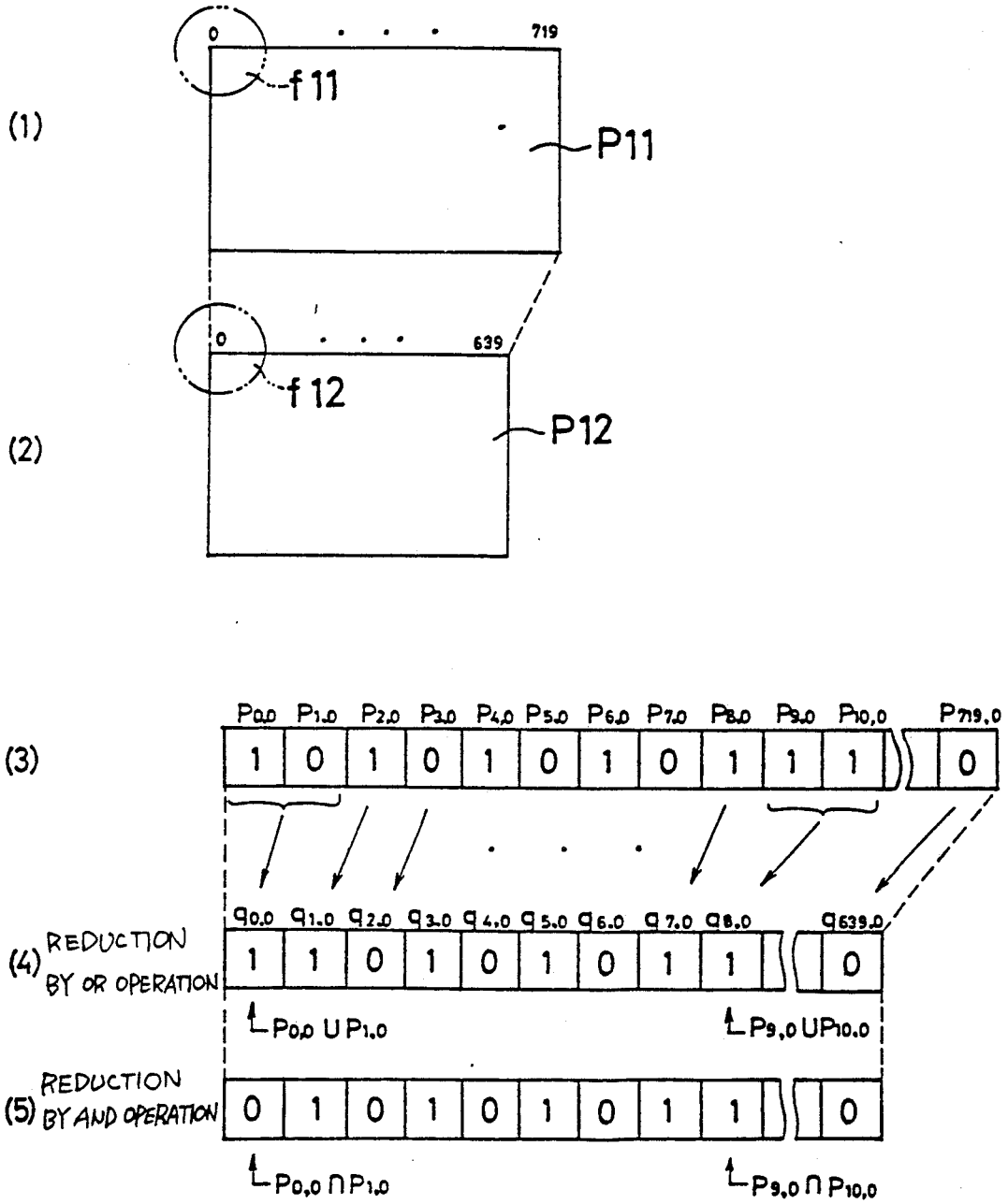
FIG. 3 illustrates more specifically the reduction of pixel data in the control device of FIG. 1.

FIG. 3 diagrammatically illustrates the manner of reducing the image in the example shown in FIG. 2. In this example, an image P11 comprising 720 dots in the horizontal direction as shown in (1) of FIG. 3 is reduced to an image P12 comprising 640 dots in the horizontal direction as shown (2) in FIG. 3. In this case, the number of vertical lines should be the same in both images. The diagrams shown in (3) to (5) of FIG. 3 show pixel data in the top left-hand corner marked with a circle in each of the images P11 and P12. If the above-mentioned OR operation is applied, for reduced display, to the first and second pixel data "1" and "0" and to the 10th and 11th pixel data "1" and "1" in the world coordinate area shown in (3) of FIG. 3, the pixel data shown in (4) of FIG. 3 are obtained. Also, if the AND operation is applied to the pixel data at the same positions, the pixel data shown in (5) of FIG. 3 are obtained.

Figure 4:
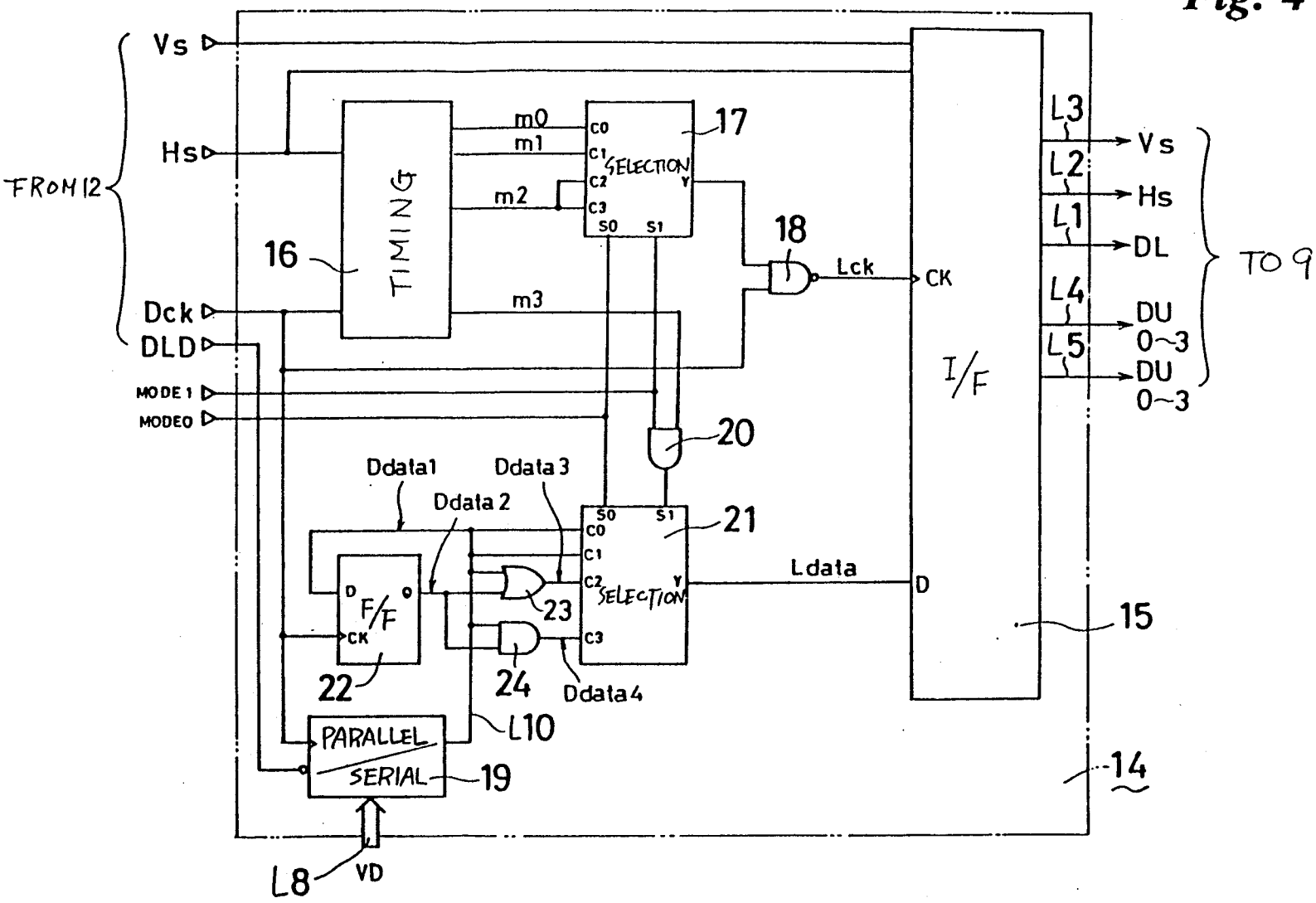
FIG. 4 is a block diagram showing the configuration of an LCD control unit used in the control device of FIG. 1.

FIG. 4 illustrates the LCD control section 14 shown in FIG. 1, and FIG. 5 is a timing chart illustrating the operation of the LCD control section 14. The LCD control section 14 comprises an interface unit 15, a timing circuit 16, a first selection circuit 17, a NAND gate 18, a parallel/serial converter 19, and AND gate 20, a second selection circuit 21, a D-type flip-flop 22, an OR gate 23, and and AND gate 24. An area control signal Vs, a line control signal Hs, a dot clock signal Dck, and a data load signal DLD are input to the LCD control section 14 from the timing signal generating circuit 12 via a control bus L9. Image data VD read from the VRAM 5 are input to the LCD control section 14 from the second multiplexer 13B via a data bus L8, and mode designating codes MODE0 and MODE1 designating the display mode are input from an appropriate input means (not shown). The image data VD is converted by the parallel/serial converter 19 into a first dot data signal Ddata1 which consists of a plurality of bits and is introduced to a line L10.

The dot clock signal Dck is a clock signal for latching the dot data signal Ddata. The timing circuit 16 is a mask signal generating means for generating a plurality kinds of mask signals relating to the serial image data on the basis of the line control signal Hs and the dot clock Dck. That is, the timing circuit 16 delivers plural kinds of mask signals m0, m1 and m2 for extracting 640 latch clock signals Lck for every field period (i.e., every one line). The timing circuit 16 also delivers a control signal m3.

Figure 5A:
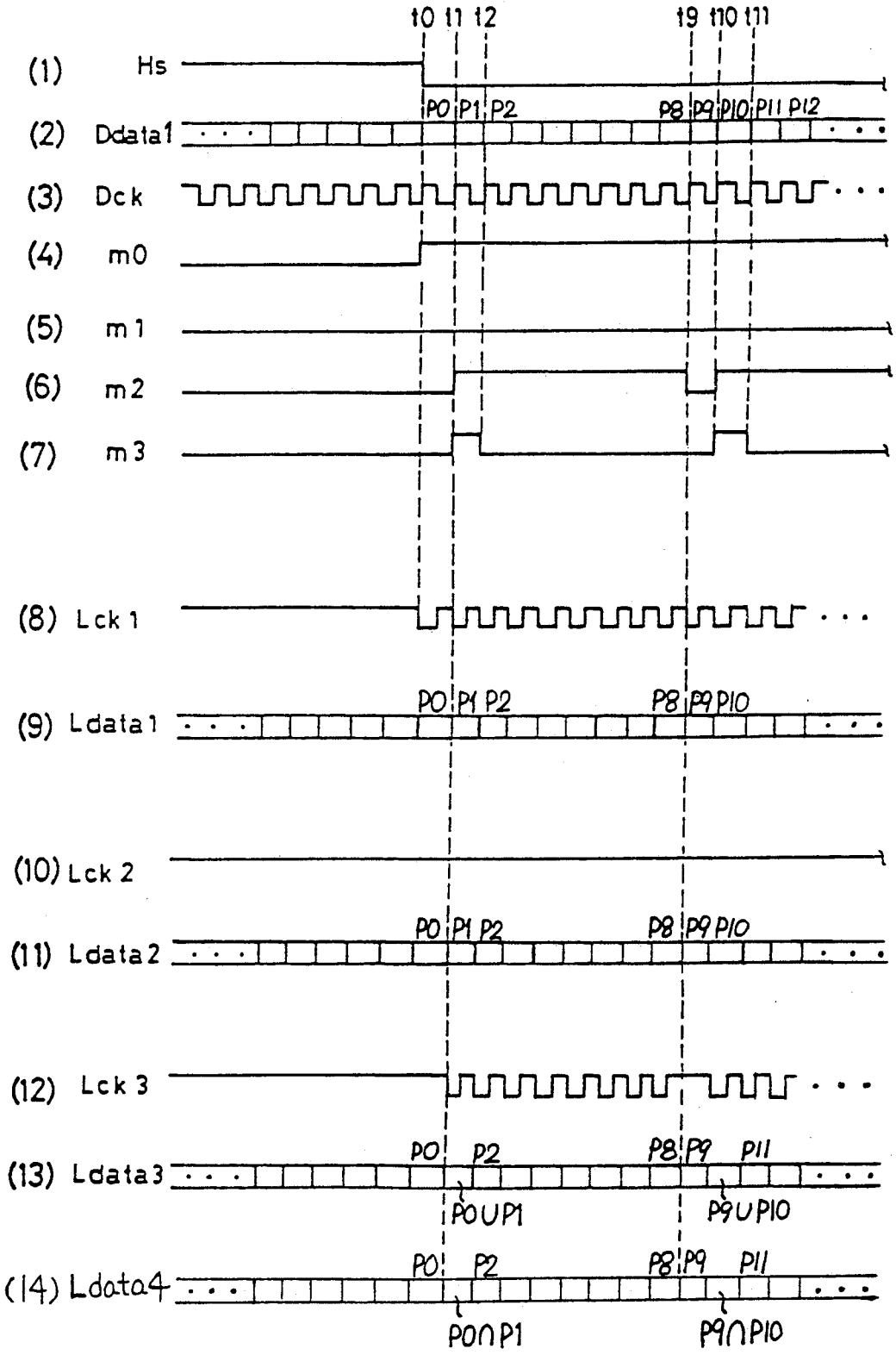
FIGS. 5A and 5B are timing charts for illustrating the operation of the LCD control unit of FIG. 4.
Figure 5B:
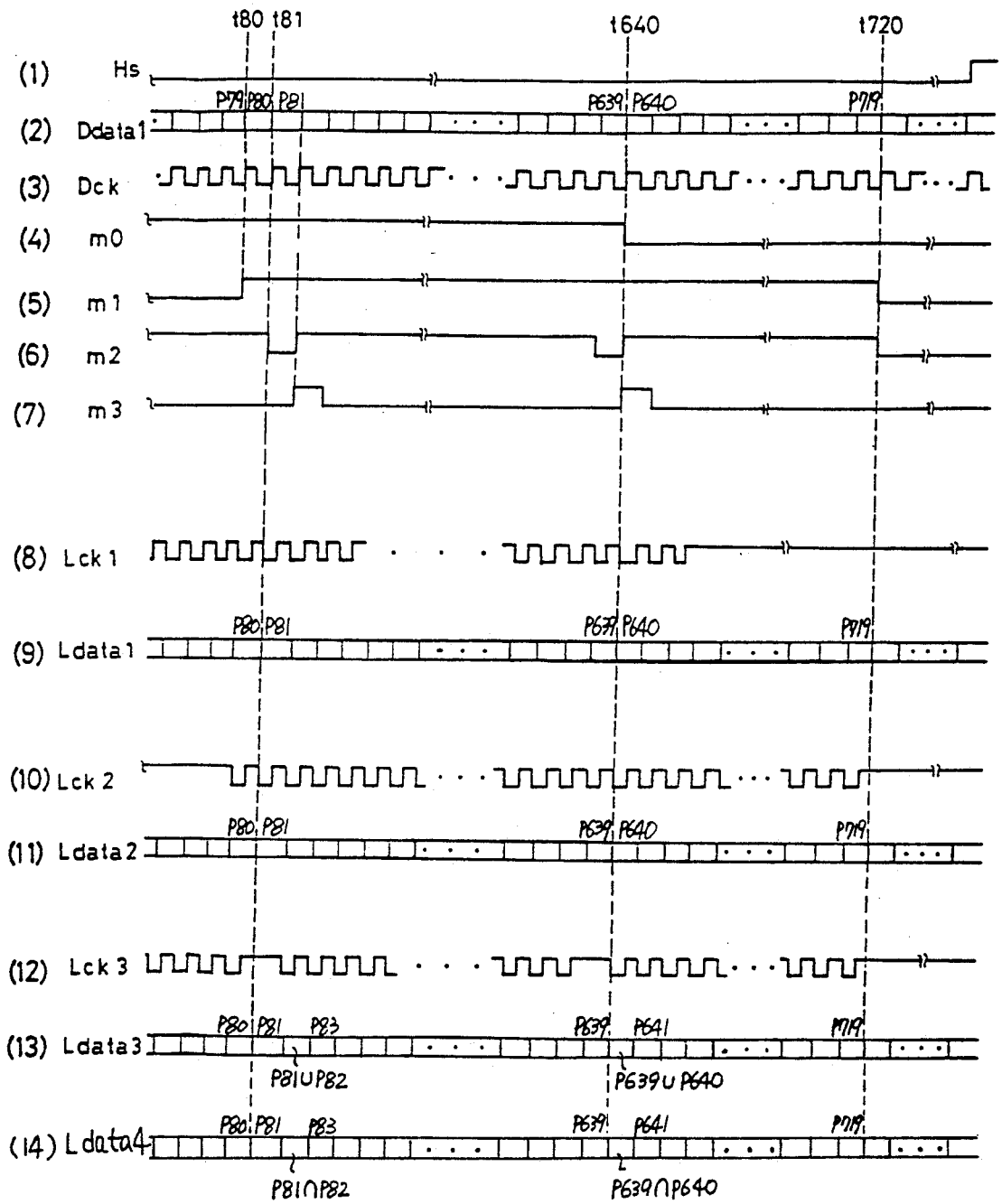
Figure 6:
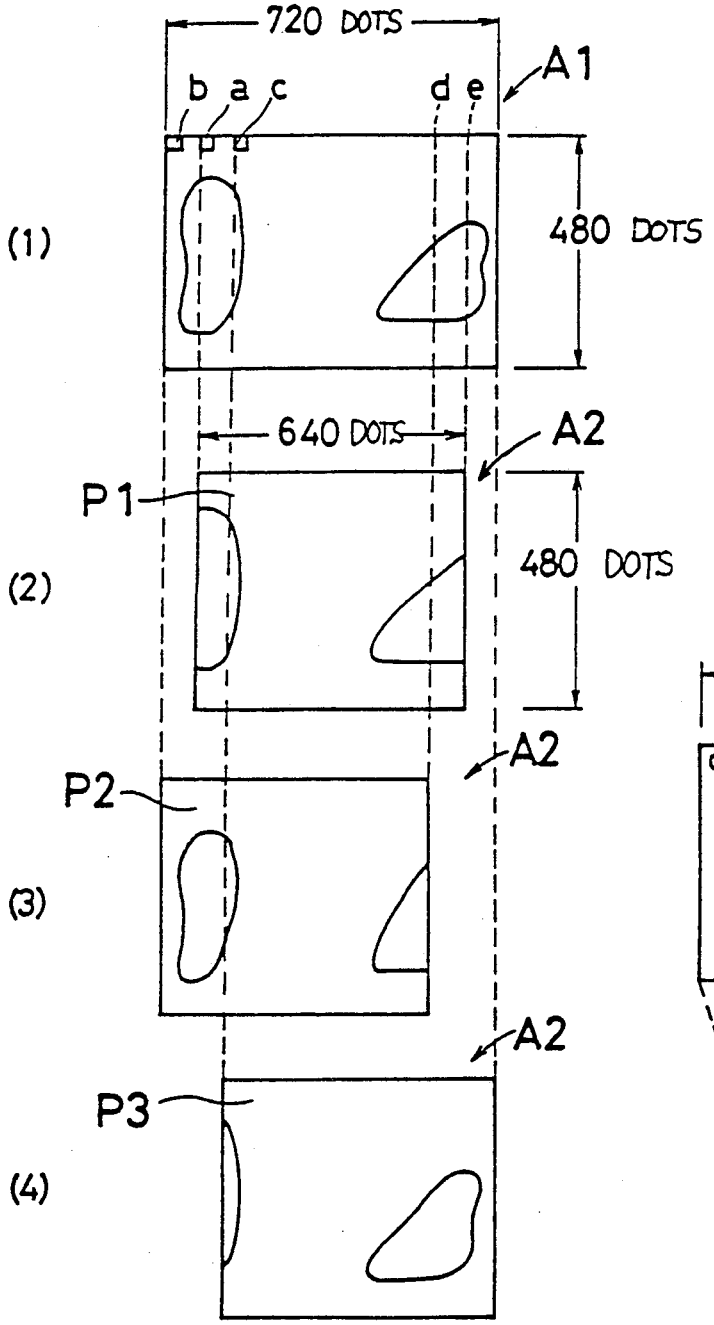
FIG. 6 is a diagram illustrating the window display technique.
Figure 7:
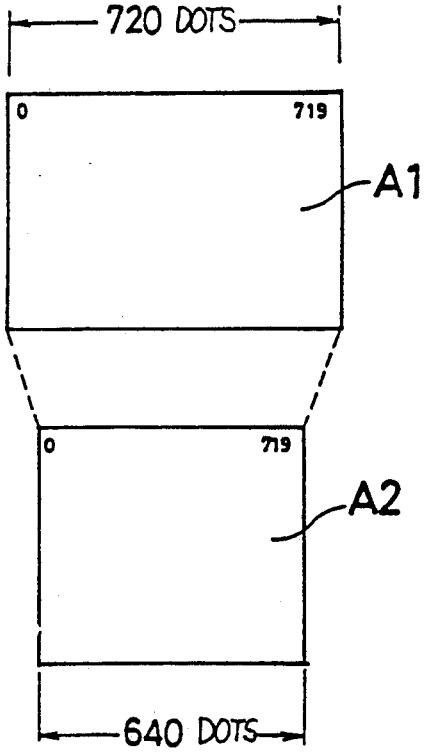
FIG. 7 is a diagram illustrating the reduced display technique.

Referring to FIGS. 5A and 5B, a waveform of the line control signal Hs is shown in (1) of FIGS. 5A and 5B, while the arrangement of the first dot data signal Ddata1 is shown in (2) of FIGS. 5A and 5B. The first dot data signal Ddata1 consists of 720 pixel data which are sequentially arranged for one horizontal period, i.e. one line, of the world coordinate area. The waveform of the dot clock signal Dck for latching the first dot data signal Ddata1 is shown in (3) of FIGS. 5A and 5B.

In (4) to (7) of FIGS. 5A and 5B, the signals m0 to m3 derived from the timing circuit 16 are shown, respectively. The first mask signal m0, as shown in (4) of FIGS. 5A and 5B, turns high from time t0 at which one horizontal period starts, through to time t640 at which the dot clock signal Dck counts 640, in synchronism with the line control signal Hs. The mask signal m0 is used for the 640-dot left window display which will be described later. On the other hand, the second mask signal m1 ((5) of FIGS. 5A and 5B) turns high from time t80 at which the dot clock signal Dck counts 80 with the time t0 as the reference point, through to time t720 at which the dot clock signal Dck counts 720, i.e. at which one horizontal period is completed. The mask signal m1 is used for the 640-dot right window display. In the embodiment, the window display is employed which starts at the leftmost position (or at the 80th dot) of the world coordinate area and ends at the 620th dot (or at the 720th dot). However, as is apparent from the drawings, by shifting the rising point of the first mask signal m0 or the second mask signal m1, the window display can be produced starting at any dot position between 0 and 719 of the world coordinate area, which makes it possible to accomplish horizontal scroll of the screen with ease, thus enhancing the effects of the display.

The waveform of the third mask signal m2 is shown in (6) of FIGS. 5A and 5B. The third mask signal m2 is derived from the timing circuit 16 in such a timing that it remains low for one clock period of the dot clock signal Dck starting at the time t0, goes high for the next 8 clock periods, and then turns low for one clock period to repeat the same cycle. The waveform of the control signal m3 is shown in (7) of FIGS. 5A and 5B. The control signal m3 is a pulse signal which goes high for one clock period of the dot clock signal Dck in synchronism with the rising of the third mask signal m2. Both the third mask signal m2 and the control signal m3 are used for the reduced display which will be described later.

Referring back to FIG. 4, the first selection circuit 17 selects one signal from signals input to four inputs C0 to C3, in accordance with the state of the signals supplied to two selection inputs S0 and S1, as shown in Table 1. The selected signal is sent out from an output Y. The mode designating codes MODE0 and MODE1 are respectively supplied to the two selection inputs S0 and S1. The mask signals m0 and m1 are supplied to the inputs C0 and C1, respectively. The mask signal m2 is supplied to both the inputs C2 and C3.

TABLE 1

| Display Mode | S0 (MODE0) | S1 (MODE1) | Selected Input | Output |
|---|---|---|---|---|
| [1] | 0 | 0 | C0 | m0 |
| [2] | 1 | 0 | C1 | m1 |
| [3] | 0 | 1 | C2 | m2 |
| [4] | 1 | 1 | C3 | m2 |

In Table 1, [1] to [4] show the display modes accomplished in the embodiment, designating respectively as follows:

[1]: 640-dot left window display;
[2]: 640-dot right window display;
[3]: 640-dot reduced display by OR operation;
[4]: 640-dot reduced display by AND operation The mask signal m0, m1 or m2 derived from the first selection circuit 17 and the dot clock signal Dck are input to the NAND gate 18 to produce latch clock signals Lck. The dot clock signal Dck is also given to the flip-flop 22. The aforementioned first dot data signal Ddata1 is fed to the data terminal D of the flip-flop 22, so that a second dot data signal Ddata2 delayed by one pulse of the dot clock signal Dck is always delivered at the output terminal Q. The second dot data signal Ddata2 is supplied to one input of the OR gate 23 and also to that of the AND gate 24. The first dot data signal Ddata1 is supplied to inputs C0 and C1 of the second selection circuit 21, and also to the other inputs of the OR gate 23 and AND gate 24. The outputs of the OR gate 23 and AND gate 24 are connected to inputs C2 and C3 of the second selection circuit 21, respectively. The mode designating code MODE0 is supplied directly to input S0 of the second selection circuit 21. The other input S1 of the second selection circuit 21 is connected to the output of the AND gate 20 to which the mode designating code MODE1 and the control signal m3 are input. The second selection circuit 21 operates in the same manner as the first selection circuit 17 as summarized in Table 2.

TABLE 2

| S0 (MODE0) | S1 (MODE1m3) | Selected Input | Output |
|---|---|---|---|
| 0 | 0 | C0 | Ldata1 |
| 1 | 0 | C1 | Ldata2 |
| 0 | 1 | C2 | Ldata3 |
| 1 | 1 | C3 | Ldata4 |

The operation of the embodiment in each display mode will be described. [1] 640-Dot left window display mode In this mode, both the mode designating codes MODE0 and MODE1 are set to zero. The first selection circuit 17 selects the input C0 to output the first mask signal m0, and the NAND gate 18 applies a NAND operation to the first mask signal m0 and the dot clock signal Dck to produce a first latch clock signal Lck1. The first latch clock signal Lck1, which has a waveform obtained by reversing that of the dot clock signal Dck, is supplied as a clock signal to a clock terminal ck of the interface unit 15.

Since the mode designating code MODE1 is 0, the output of the AND gate 20 is 0 irrespective of the state of the control signal m3. Thus, the selection terminal S1 of the second selection circuit 21 is always at 0, and the second selection circuit 21 selects the first dot data signal Ddata1 which is fed to the input terminal C0, thereby producing the first latch data signal Ldata1 shown in (9) of FIGS. 5A and 5B to supply it to the data terminal D of the interface unit 15. Using the first latch data signal Ldata1 and the first latch clock signal Lck1, the interface unit 15 extracts the left-side 640 dots, i.e. pixel data $p_0$ to $p_{639}$, from the 720 dots of the world coordinate area, to output them to the buffer circuit 9 (FIG. 1). [2] 640-Dot right window display mode In this mode, the mode designating codes MODE0 and MODE1 are set to 1 and 0, respectively. The first selection circuit 17 selects the second mask signal m1. The NAND gate 18 applies a NAND operation to the mask signal m1 and the dot clock signal Dck to produce a second latch clock signal Lck2 which is shown in (10) of FIGS. 5A and 5B. Since MODE1=0, the output of the AND gate 20 (and thus, the selection terminal S1 of the second selection circuit 21) is always at 0. The second selection circuit 21 selects the first dot data signal Ddata1 which is fed to the input terminal C1, thereby producing the second latch data signal Ldata2 shown in (11) of FIGS. 5A and 5B. Using the second latch data signal Ldata2 and the second latch clock signal Lck2, the interface unit 15 extracts the right-side 640 dots, i.e. pixel data $p_{80}$ to $p_{719}$, from the 720 dots of the world coordinate area. The extracted pixel data are supplied to the buffer 9.

The window display according to the embodiment is accomplished by hardware as described above, not by software processing such as processing data in the VRAM or changing parameters, which has been the case with the prior art. According to the invention, therefore, the window display is possible while retaining the compatibility of softwares. [3] 640-Dot reduced display mode by OR operation The mode designating codes MODE0 and MODE1 are set to 0 and 1, respectively. Therefore, the first selection circuit 17 selects the mask signal m2. The NAND gate 18 applies a NAND operation to the mask signal m2 and the dot clock signal Dck to produce a third latch clock signal Lck3. The latch clock signal Lck3 has a waveform in which one pulse is decimated for every nine pulses, such as shown at the time t9 in (12) of FIG. 5A, so that 640 pulses are generated during one horizontal scan period. The decimation of pulses causes the duty ratio to change. Since the data is latched at the rising or falling edge of the clock, however, no problem will be caused. In this mode, for every ninth period of the third latch data signal Ldata3, the operation result of two pixels is substituted into one pixel data (in the embodiment, $p_0 \cup p_1$, $p_9 \cup p_{10}$, . . . , where the symbol "$\cup$" denotes an OR operation).

Since MODE1=1, the control signal m3 appears at the output of the AND gate 20, and thus the control signal m3 is applied to the selection input S1 of the second selection circuit 21. The mode designating code MODE0 which is zero is given to the other selection input S0 of the second selection circuit 21 so that the input C2 is selected when the control signal m3 is high, and that the input terminal C0 is selected when the control signal m3 is low.

The second dot data signal Ddata2 which is delayed by one clock of the dot clock signal Dck is always derived at the output terminal Q of the flip-flop 22. Hence, data of two adjacent pixels are always input to the OR gate 23 to be subjected to an OR operation. The third dot data signal Ddata3 which is obtained as a result of the OR operation is fed to the input C2 of the second selection circuit 21. Therefore, the second selection circuit 21 selects the third dot data signal Ddata3 when the control signal m3 is high, and the first dot data signal Ddata1 in other timings, to deliver them as a third latch data signal Ldata3. In this way, nine dot data are reduced to eight dot data. As a result, the third latch data signal Ldata3 in which one data obtained by the OR operation of two pixel data is inserted for every nine data is input to the interface unit 15.

By latching the third latch data signal Ldata3 with the timing of the third latch clock signal Lck3, the interface unit 15 accepts data of seven pixels (for example, $p_2$ to $p_8$, $p_{11}$ to $p_{17}$, . . . ) out of nine pixels without processing, and employs as one data the result of the OR operation applied to the data of the remaining two pixels (for example, $p_0 \cup p_1$, $p_9 \cup p_{10}$, $p_{18} \cup p_{19}$, . . . ). The resulting data are introduced to the buffer circuit 9.

[4] 640-Dot reduced display mode by AND operation

In this case, both the mode designating codes MODE0 and MODE1 are set to 1. The first selection circuit 17 selects the input C3 to which the mask signal m2 is supplied. Therefore, the first selection circuit 17 operates in the same manner as in the above-described display mode [3] (i.e. the mode of OR operation) to produce the third latch clock signal Lck3 by decimating one pulse for every nine pulses.

The control signal m3 is applied to the selection input S1 of the second selection circuit 21, and the mode designating code MODE0 which is supplied to the other selection input S0 is 1. Therefore, the second selection circuit 21 selects the fourth input C3 when the control signal m3 is high, and the second input C1 when the control signal m3 is low.

As mentioned above, the second dot data signal Ddata2 is delayed by one clock from the dot clock signal Dck. Hence, data of two adjacent pixels are always input to the AND gate 24 to be subjected to an AND operation. The fourth dot data data signal Ddata4 which is a result of the AND operation is fed to the input C3, so that the second selection circuit 21 selects the fourth dot data signal Ddata4 when the control signal m3 is high, and the third dot data signal Ddata3 in other timings, to deliver them as a fourth latch data signal Ldata4. As a result, the fourth latch data signal Ldata4 in which one data obtained by the AND operation of two pixel data is inserted for every nine data is input to the interface unit 15.

By latching the fourth latch data signal Ldata4 with the timing of the third latch clock signal Lck3, the interface unit 15 accepts data of seven pixels (for example, $p_2$ to $p_8$, $p_{11}$ to $p_{17}$, . . . ) out of nine pixels without processing, and employs as one data the result of the AND operation applied to the data of the remaining two pixels (for example, $p_0 \cap p_1$, $p_9 \cap p_{10}$, $p_{18} \cap p_{19}$, . . . ). The resulting data are introduced to the buffer circuit 9.

The reduced display according to the embodiment is accomplished, not by simply decimating data which has been the case with the prior art, but by interpolating the missing pixel data by applying an operation to the data of the adjacent pixels, thus allowing the original display information stored in the image memory to remain intact. As described above, according to the embodiment, the display control is processed, not by software as in the prior art, but by hardware, realtime display can be accomplished.

In the above description, an LCD apparatus is used as a display means, but the control device according to the present invention is applicable to other display means such as those using a CRT display, or those having poxels formed from a plurality of light emitting elements.

As described above, all the means can be accomplished by hardware. Hence, the display control can be processed in realtime, eliminating the need for processing a large software which manages the display areas to suit the desired display mode, and saving the trouble of rewritting data to the image data memory section. Thus, according to the invention, the original image data stored in the image data memory section remains completely intact, ensuring the reproducibility and safety of the application software that manages the display areas. Also, since reduction of data necessary for reduced display is performed by applying an operation to the two adjacent image data, the omission of data inherent in the prior art can be prevented, thus providing reduced display with minimized distortion.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A control device for a display apparatus in which pixels are arrange in a matrix, comprising:

image data string generating means for generating a first serial image data string in synchronization with the horizontal scanning of said display apparatus, said image data string generating means being connected to memory means for storing image data;

image data delaying means for generating a second serial image data string in which each data is delayed from the corresponding data of said first image data string by a period of time corresponding to at least one pixels;

mask signal generating means for generating a plurality of mask signals;

first operation means for applying a first operation to said first and second image data strings to obtain a third image data string;

mask signal selecting means for selecting one or more mask signals from said mask signals in accordance with a desired display mode;

data image selecting means for selecting one or more image data strings from said first to third image data strings, and producing a further iamge data string; and output means for masking said further image data string in accordance with said selected mask signals, and outputting said masked image data string to said display apparatus.

2. A device according to claim 1 wherein said first operation is an OR operation.

3. A device according to claim 1 wherein said first operation is an AND operation.

4. A control device for a display apparatus in which pixels are arranged in a matrix, comprising:

image data string generating means for generating a first serial image data string in synchronization with the horizontal scanning of said display apparatus, said image data string generating means being connected to memory mean for storing image data;

image data delaying means for generating a second serial image data string in which each data is delayed from the corresponding data of said first image data string by a period of time corresponding to at least one pixel;

mask signal generating means for generating a plurality of mask signals;

first operation means for applying a first operation to said first and second image data strings to obtain a third image data string;

second operation means for applying a second operation to said first and second image data strings to obtain a fourth image data string;

mask signal selecting means for selecting one or more mask signals from said mask signals in accordance with a desired display mode;

data image selecting means for selecting one or more image data strings from said first to fourth image data strings, and producing a further image data string; and output means for masking said further image data string in accordance with said selected mask signals, and outputting said masked image data string to said display apparatus.

5. A device according to claim 4 wherein said first operation is an OR operation.

6. A device according to claim 4 wherein said second operation is an AND operation.

* * * * *